US005356324A

United States Patent [19]

Cunningham

[11] Patent Number: 5,356,324

[45] Date of Patent: Oct. 18, 1994

[54] RETRACTABLE, AND ADJUSTABLE FIN BOX MECHANISM

[76] Inventor: Eugene F. Cunningham, 480 S. Joanne Ave., Ventura, Calif. 93003

[21] Appl. No.: 122,048

[22] Filed: Sep. 13, 1993

[51] Int. Cl.[5] ..... B63B 35/00

[52] U.S. Cl. ..... 441/079; 441/71

[58] Field of Search ..... 441/65, 74, 71, 79; 114/127-139

[56] References Cited

U.S. PATENT DOCUMENTS

| | | | |
|---|---|---|---|
| 3,066,327 | 12/1962 | Durfey | 441/79 |
| 3,087,173 | 4/1963 | Meyer | 441/79 |
| 3,103,673 | 9/1963 | Martin | 441/79 |
| 3,516,100 | 6/1970 | Ellis | 441/79 |
| 3,564,632 | 2/1971 | Bahne | 441/79 |
| 3,585,663 | 6/1971 | Johnson | 441/79 |
| 3,685,068 | 8/1972 | Reed | 441/71 |
| 3,756,182 | 9/1973 | Hackett | 114/132 |
| 4,699,596 | 10/1987 | Klinker et al. | 441/71 |
| 5,133,681 | 7/1992 | Lobe | 441/79 |
| 5,147,235 | 9/1992 | Bamburak et al. | 441/79 |

FOREIGN PATENT DOCUMENTS

| | | | |
|---|---|---|---|
| 2010189 | 6/1979 | United Kingdom | 114/130 |

*Primary Examiner*—Stephen P. Avila

[57] ABSTRACT

A long and slender box shaped fin holder, that provides a pinned connection between the fin and the holder box. The pinned connection is located within the box itself, so as to allow rotational capabilities, while also offering lateral stability to the fin from the sides of the holder box. The rotational freedom of the fin is regulated by a spring type device attached to the leading edge of the fin and at the same time, to the forward wall of the holder box. The holder box is also equipped with a latch type device to facilitate locking the fin in a fully retracted position, which primarily conceals the fin within the holder box. This holder box is embedded within the top and the bottom surfaces of a typical surfboard, kneeboard, or windboard, typically near the rear of the board. This holder box is also equipped, within the box its self, a wedged shaped member designed to collect moving water from beneath the board, and discharging that water out the top surface of the holder box and therefore the board, as a visual measurement of speed and maneuvers.

4 Claims, 1 Drawing Sheet

FIG. 1.
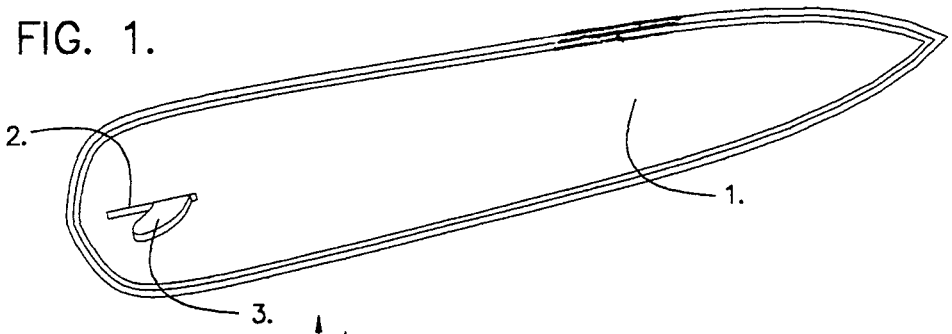
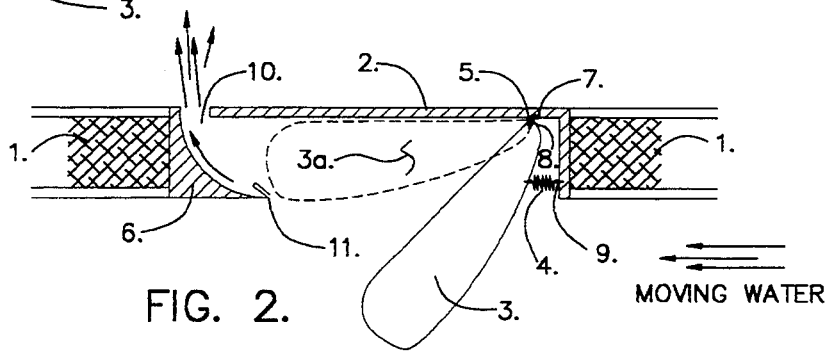
FIG. 2.
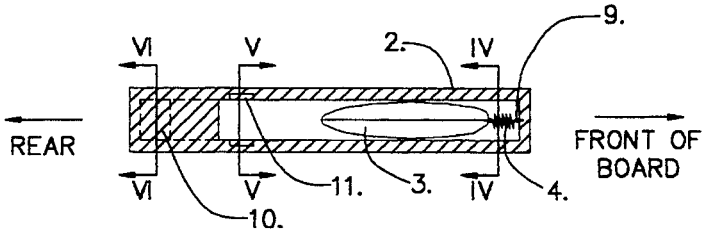
FIG. 3.
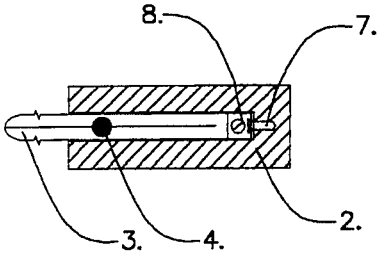
FIG. 4.
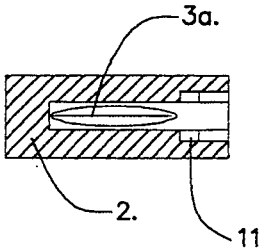
FIG. 5.
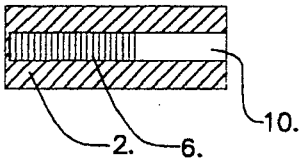
FIG. 6.

RETRACTABLE, AND ADJUSTABLE FIN BOX MECHANISM

BACKGROUND-FIELD OF INVENTION

This invention relates to fins or skegs used in water sport equipment such as surfboards, sailboards, knee board, and bodyboards, henceforth referred to as waveboards. Surfing and sailboarding have both become major sports in many coastal areas, as well as, water parks and in most countries of the world. World competition and Olympic events, have stressed and strained at the skills and performance levels, in these water sports.

Any waterboard, especially a surfboard, generally comprises a longitudinal board with a controlled fin or fins positioned on the rear bottom surface. The fin is used to control movement of the board through manipulation of the board and the attached fin by the riders position and shifting of his body weight. The position of the fin and the amount of exposed surface area are therefore very important in maneuvering of these water boards. There are many factors involved in effectively controlling turns on these boards, such as size and weight of both the board and the rider, riders position on the board, type and speed of waves or water shape, the fin location and the amount of it's exposed surface area.

In addition, to the obvious need for a fin system, by which to maneuver ones board in the water, there is also a need for a safer and more efficient system. Today, there is still an unacceptable number of water board injuries. Many are attributed to coming in direct or indirect contact with the rigidly fixed fin systems used today.

Also noting, that the sports have taken on considerable traveling by plane, boat, rail or vehicle to just surf or compete. This has continued to be a problem for both the carriers and the board owners in the number of damaged boards. Most of which, are due to the rigidly fixed fin system.

BACKGROUND-DESCRIPTION OF PRIOR ART

My research into prior art and patents, have resulted in the following statements; Heretofore, there have been no patents directly awarded to fins or skegs (henceforth referred to simply as fins) no-doubt on the basis that the concept pre-existed with early man. In recent years, improvements, not on the fin itself, but the removable capabilities and forward or backward adjustability have been patented. Commonly referred to as the "Adjustable Surfboard Fin Holder" by W. L. Bahne of San Diego, U.S. Pat. No. 3,564,632. This however, is still a rigidly fixed fin system. There have been some patents whose ideas have danced around the concepts of adjustability and pivoting, such as, U.S. Pat. No. 3,516,100; retractable, U.S. Pat. No. 3,087,173; frangible, U.S. Pat. No. 5,133,681, and even a protective cover concept for transport, U.S. Pat. No. 5,147,235. One prior art referred to as "Automatically Adjusting Skeg", U.S. Pat. No. 3,516,100 approaches the idea of a spring loaded type, retracting fin, however, does not in any way achieve the objectives or advantages to be presented. It does not achieve a more efficient performance, because of it's bulky design, high drag coefficient, and the fact that it's still a rigidly fixed fin design. The rotating/retracting fin actually rotates within a fixed fin. This fin concept does not meet any of the other objectives to be stated such as safety or vulnerability, again because, by design, it essentially is still a rigidly fixed fin. All of these prior arts, in a very simplistic and one idea-in-mind type philosophy, have tried to deal with, generally one problem only, and thus a solution.

One problem of impacts to the fin that results in severe damage to the fin, board and holder, not to mention whatever or whomever impacted it, have been addressed in various frangible retaining ideas.

While the conceptually advantageous aspects, of longitudinally adjustable and removable, have been addressed more recently and marketably. Fin protection during storage, transport, laying down, stacking or any real impact while on land, has only been slightly addressed in manners such as protective covering and board bags.

None to date, have cumulatively addressed these various hazards, problems and concerns, not to mention the unaddressed aspects of fin safety, performance and efficiency. None have addressed so many and real problems associated with the original fixed-fin concept and yielded a simple, constructable, maintainable and inexpensive concept. Therefore, no prior patented art in any way resembles or comes close to this invention.

Pre-existing art suffers from several disadvantages;

a) The pre-existing fin concept (rigidly fixed) has always struggled in balancing between efficient fluid dynamics (minimizing induced and parasite drag coefficients) and exposed surface area (required for turning or maneuvering). Recent trends, have been to add more streamline shaped fins to the water sport equipment. This is more of a fad than a solution to any of the problems to be discussed, especially since the board rotates essentially around the fin location, when initiating a turn.

b) The fixed-fin configuration, from conception, has always been a safety hazard. Numerous (thousands) documented water sport accidents have resulted in serious head or sliced abrasion type injuries as a direct result of coming in contact with the fixed-fin. Many of my friends and co-water athletes have been accidently run over by a fellow surfer or windboarder, or even struck by ones own board and/or fin.

c) The rigidly fixed-fin concept has always been susceptible to easily being damaged, not only in use in the water, but also on land and in transport. Many simple and unavoidable acts have been damaging to the fixed-fin configuration on surfboards and windboards such as; 1. Dropping or even placing them on hard surfaces (even sand). 2. Running aground on the sand or rocks. 3. Coming in contact with floating objects such as logs, debris or seaweed. 4. Coming in contact with a fellow surfer or their board. 5. Typical transportation hazards associated with stacking and packaging boards along with poor baggage and handling practices in airport, bus and train stations.

d) Replacement of damaged fins has always been an expensive and tedious task. This feat was generally left to the professional board repair shops because it involved cutting out the remaining portion of damaged fin, installing a new fin by setting in resin, then re-fiberglassing around the damaged area. The manufacturing of the patented fin-box helped somewhat in this area. However, falling short for the following reasons. The fin-box only allowed removal, replacement, or adjustment (forward and backwards). The fin-box is still a rigid fixed fin configuration. Therefore, when only minor contact was experienced on the fin, and it was only cracked or broke, you could then easily replace it. If moderate to severe contact is made, then damage usually includes the fin, fin-box, the board, and involves professional repair as previously described.

OBJECTS AND ADVANTAGES

Accordingly several objects and advantages of my invention are: To provide a newly improved, safer, more effective, less vulnerable, inexpensive, self-contained, and easily maintained retractable fin-box mechanism.

a) To provide better balancing of the fluid dynamics with the required surface area needed for maneuvering, this is achieved, with a simple systematic mechanical, automatic retracting feature. The retractable-fin will begin to retract when the leading edge pressures, which are created by the board's forward motion in the water, are sufficient (for example; in a moderate to high speed condition). When a maneuver or a turn is initiated, the leading edge pressures will drop thus re-exposing the fin surface area as it is needed for turning. The expected result is a slight increase in board speed, relative to the water, as a result of less fin drag.

b) To provide improved safety features in the aspect that should you or a fellow surfer/windboarder be run over by the board or simply come in contact with the fin during a crash, the retractable capabilities of the fin will significantly reduce the severity and/or even the chance of injury. Further, when the board is moving forward and the fin comes in contact with some underwater obstruction such as rocks, reef, debris, ocean-bottom, or kelp the "lunge forward" aspect usually associated, will be minimized by the forgiveness of the fins' retractable mechanism.

c) To provide improved capabilities to place your board in a fin-down configuration on the ground or in shallow water, while also providing, a term locking feature with a holding latch for transporting, shipping, or in stacking of several boards. Locking capabilities in the retracted position is an ideal feature to minimize fin damage while in vulnerable locations.

d) To provide easy maintenance and removability of all the components, as well as interchangeable parts and adjusting capabilities. Options such as partially or fully retractable fin, mounting point selection, adjustable fin retraction-tension, fin and misc. hardware replacement capabilities with simply a screwdriver.

e) To provide a novelty concept, in having a stream of moving water discharged or projected out the top rear of the water board, as a visual measure of water speed and maneuvers performed. Similar to boats and jet-skis, and some times referred to as a rooster-tail spray. This was an unexpected result.

f) To provide all of the above mentioned advantages of better performance and safety, less vulnerability, and a novelty aspect to not only newly constructed boards, but old in-use boards too.

DRAWING FIGURES

FIG. 1 Is a typical isometric view of a common sail or surf board from beneath, with a typical fin. Not to scale.NTS FIG. 2 Is a blown up side cross-section view of the fin box mechanism, and fin configuration (in two positions) relative to the water board. Positions are fully exposed and retracted. NTS FIG. 3 Is typical plan view of the fin box mechanism and fin configuration looking from beneath the waterboard.

FIG. 4 Is a cut cross section view of the fin box mechanism, and fin configuration as shown in FIG. 3.

FIG. 5 Is a cut cross section view, as shown in FIG. 3 of the Holding Latch detail.

FIG. 6 Is a cut cross section view, as shown in FIG. 3 at the faring shaped wedge member and the water spray discharge outlet location.

Reference Numerals In Drawings

FIG. 1, FIG. 2, FIG. 3, FIG. 4, FIG. 5, and FIG. 6.

1. Surfboard, kneeboard, body board, windboard. "waterboard"
2. Fin-box-member
3. Fin-member (fully exposed position)
3*a*. Fin-member (retracted position)
4. Spring-Mechanism
5. Support-Mechanism (Pinned connection, illustrayed as hinge)
6. Faring-Shaped-Wedge-Member
7. Mounting-Points (Illustrated as threaded Inlets)
8. Threaded-Inlets-w/screw (Illustrated as hinge)
9. Threaded-Inlets-w/eye bolts (spring detail)
10. Water-Spray-Discharge-Outlet
11. Holding-Latch

DETAINED DESCRIPTION OF DRAWINGS

Referring to the attached drawings, a surf board, wind board, body board, knee board, or belly board, from here on referred to, and illustrated as a surf board 1 of any numerous desired length, width, and thickness configuration, has a fin-member 3 and a fin-box-member 2 as illustrated in FIG. 1. The fin-member 3 is attached to the fin-box-member 2 by means of a support-mechanism 5. The support-mechanism 5 is secured to the fin-member 3 with a threaded-inlet/screw 8, same as it is secured to the fin-box-member 2, only without a selection of mounting-points 7 locations. The fin-member 3 is also attached to the fin-box-member 2 by means of a spring-mechanism 4. The spring-mechanism 4 is secured to both the fin-member 3 and the fin-box-member 2 with threaded-inlet-eye/bolts 9.

When transporting or stacking boards, you can minimize the fin vulnerability, by hand retracting the fin-member 3 to the fully retracted position 3*a* then utilize the holding-latch 11 to hold in place, secured with in the fin-box member 2.

A novelty option can be utilized with the faring-shaped-wedge-member 6 in place. The water flowing around the fin-member 3 will be channeled and then discharged through the water-spray-discharge-outlet 10. This water spray can serve as a visual measure of water speed and maneuvers.

The fin-box-member 2 is secured into a recessed slot underneath the surf-board 1, with it's lower surface flush with the underneath surface of the surf-board 1, by any feasible manner such as plastics, resins, or fiberglass.

Installation begins with the fin-member 3 attached to the support mechanism 5 by means of a threaded-inlet/-screw 8. The fin-member 3 is then placed into the fin-box-member 2, aligning the hinge hole with the selected location of the mounting-point 7. The spring-system 4 is then attached to both the fin-member 3 and the fin-box-member 2 by means of the threaded-inlet-eye/bolts 9. The spring-mechanism 4 will have a proper size/length spring to achieve the desired fin-member 3 rotation resistance all the way to the fully retracted fin-member 3*a* position. The base (the thick portion inside the fin-box-member 2) shape of the fin-member 3 will conform to the inside surface dimensions of the fin-box-member 2, minus approx. ⅛" to achieve lateral stability of the fin-member 3, yet able to rotate freely forward and backward around the support-mechanism 5. How freely, will depend on the leading edge forces applied by the water verses the spring-mechanism 4 desired tension.

Having described my invention, I now claim the following:

1. A fin assembly for use on a sail, surf, or knee board comprising:

a fin box member sized and shaped to fit completely within the board;

a fin member sized and shaped to fit either completely within the box member or partially within the fin box member as desired when in a retracted position, and to extend below the box when in an exposed position;

a fin support mechanism, mounted completely within the fin box member, including support means for supporting the fin member in the fin box member and retracting means for retracting the fin member from an exposed position to a retracted position;

a holding latch mechanism, mounted completely within the fin box member, including locking means for locking the fin member in a retracted position;

a faring shaped wedge member, housed completely within the fin box member and directly aft of the fin member when the fin member is in a retracted position, for collecting water from beneath the board while it is moving and discharging such water out the top rear of the board.

2. A fin assembly as claimed in claim 1 further comprising:

the fin support mechanism support means having a plurality of mounting points for selecting longitudinal positioning of the fin member within the box member.

3. A fin assembly as claimed in claim 1 further comprising:

the fin support mechanism includes adjusting means for adjusting the amount of retraction resistance.

4. A fin assembly as claimed in claim 1 further comprising:

the fin support mechanism allows the fin to automatically retract, from an exposed position to a retracted position, dependant upon dynamic fluid pressure or an impact force imposed upon the fin member.

* * * * *